US007762204B2

(12) United States Patent
Smith

(10) Patent No.: US 7,762,204 B2
(45) Date of Patent: Jul. 27, 2010

(54) RETRACTABLE BOWSPRIT FOR A SAILING VESSEL

(76) Inventor: Kenneth R. Smith, 7245 SW. Ashdale, Portland, OR (US) 97223

( * ) Notice: Subject to any disclaimer, the term of this patent is extended or adjusted under 35 U.S.C. 154(b) by 0 days.

(21) Appl. No.: 12/283,198

(22) Filed: Sep. 10, 2008

(65) Prior Publication Data

US 2009/0090287 A1 Apr. 9, 2009

Related U.S. Application Data

(60) Provisional application No. 60/993,511, filed on Sep. 11, 2007.

(51) Int. Cl.
*B63B 15/00* (2006.01)
*B63H 9/10* (2006.01)

(52) U.S. Cl. ..... 114/97; 114/98; 114/89

(58) Field of Classification Search ..... 114/89, 114/97–99, 102.1, 102.28, 102.29, 343, 364
See application file for complete search history.

(56) References Cited

U.S. PATENT DOCUMENTS 1,891,555 A * 12/1932 Rockwood ..... 114/39.21
4,292,910 A 10/1981 Hoyt
4,501,217 A 2/1985 Hoyt
5,109,786 A 5/1992 Hall
5,243,924 A * 9/1993 Mann ..... 114/61.16
5,347,945 A 9/1994 McAlpine
5,765,498 A * 6/1998 Hammarstedt ..... 114/97
6,425,338 B1 7/2002 Stevenson, IV
6,647,917 B1 * 11/2003 Hoyt ..... 114/364

* cited by examiner

*Primary Examiner*—Daniel V Venne
(74) *Attorney, Agent, or Firm*—Chernoff, Vilhauer, McClung & Stenzel

(57) ABSTRACT

A bowsprit for a sailing vessel having a deck and a hull. A supporting member of the bowsprit has first and second opposing ends and is pivotably attachable to the deck such that the opposing ends of the supporting member extend outwardly past the hull. First and second movable members of the bowsprit are joined at an apex. First and second movable members are for disposition substantially adjacent to respective outer sides of the sailing vessel such that the apex is forward of the vessel and the first and second movable members are supported by and are slidable over the supporting member.

6 Claims, 3 Drawing Sheets

RETRACTABLE BOWSPRIT FOR A SAILING VESSEL

CROSS-REFERENCE TO RELATED APPLICATIONS

This application claims the benefit of Provisional Application No. 60/993,511, filed 11 Sep. 2007, the entire contents of which are hereby incorporated by reference.

BACKGROUND OF THE INVENTION

The present invention relates to a retractable bowsprit for use with a sailboat.

FIG. 1 illustrates a conventional sailboat 2, more specifically a yacht having a Bermudan sloop sail plan. A Bermuda rigged sloop is a common configuration of sailboat and is characterized by a single hull 4, a single mast 6 and two fore-and-aft rigged sails: a triangular mainsail 10 and one of several possible types of interchangeable foresail. A Bermuda sloop commonly carries at least two types of foresail to be used depending on the desired point of sail. A staysail 12, such as a jib or a genoa, is used when reaching (sailing across or into the wind) and a downwind sail (FIG. 2), such as a symmetric or asymmetric spinnaker, is used when running (sailing within approximately 30° of directly downwind). The mast 6 may be stabilized by a forestay 16, running from the bow 18 to the mast head 22 and a back stay (not shown), running from the stern 28 to the mast head. A pivotable horizontal spar (boom) 40 for orienting the mainsail 10 extends aft from the mast 6. The mainsail 10 helps to propel the sailboat 2 and also acts as a rudder for controlling the boat's direction of travel The greater the surface area of the sails, the more wind power can be harnessed. The surface area of both sails is limited by the height of the mast 6. The surface area of the mainsail is further limited by the length of the boom 40 whereas the surface area of the foresail is further limited by how far forward of the mast the foresail's tack 30 can be fixed.

When reaching the sails act as wings, redirecting air blowing in from the side of the boat towards the stern, thereby creating lift that moves the boat forward. The staysail's luff is attached to the forestay 16 and the tack 30 is fixed to a point forward of the mast, such as the bow 18. The clew 54 is movable relative to the sailboat 2. The trim of the staysail is controlled by adjusting the position of the clew 54. When transitioning from reaching to running, the staysail is lowered and a downwind sail, such as an asymmetric spinnaker, is run up in its place.

Referring to FIG. 2, when running, both sails trap air as it flows by, essentially causing the wind to drag the boat along with it. Like a staysail, the tack 59 of an asymmetric spinnaker 63 is attached to a fixed point forward of the mast, such as the bow or to a bowsprit 61, and the clew 65 is attached to a spinnaker sheet 67. The bowsprit 61 is a spar positioned to extend forward from the bow, essentially increasing the effective length of the boat and, consequently, increasing the maximum size of foresail that can be used. Unlike a staysail or the mainsail, the asymmetric spinnaker is not attached to the boat along any of the sail's edges. This allows the asymmetric spinnaker 63 to fill with wind and balloon out in front of the sailboat 2 when deployed.

A bowsprit is advantageous for use in sailing because it increases the effective length of the boat, allowing for a larger sail and therefore greater surface area. However, this increase in effective length can be a hindrance when performing precise maneuvering, such as when docking. Therefore sailboats may utilize a retractable bowsprit which can be extended when needed and stored when not in use. One type of conventional retractable bowsprit is a single spar that extends outwardly from the bow. When not in use, the retractable bowsprit is stored either just above or just below the level of the deck. However, such retractable bowsprits take up valuable space when not they are in use. They also pose a safety concern: if the bowsprit comes loose it will most likely be projected violently backwards from the bow towards the crew. Also, such a retractable bowsprit is not easily installable on a pre-existing sailboat. Thus, what is needed is a retractable bowsprit that does not take up unnecessary space on the sailboat, maximizes the safety of the boat's crew, and which can be easily installed on a variety of sailing vessels.

DETAILED DESCRIPTION OF PREFERRED EMBODIMENTS

Figure 2:
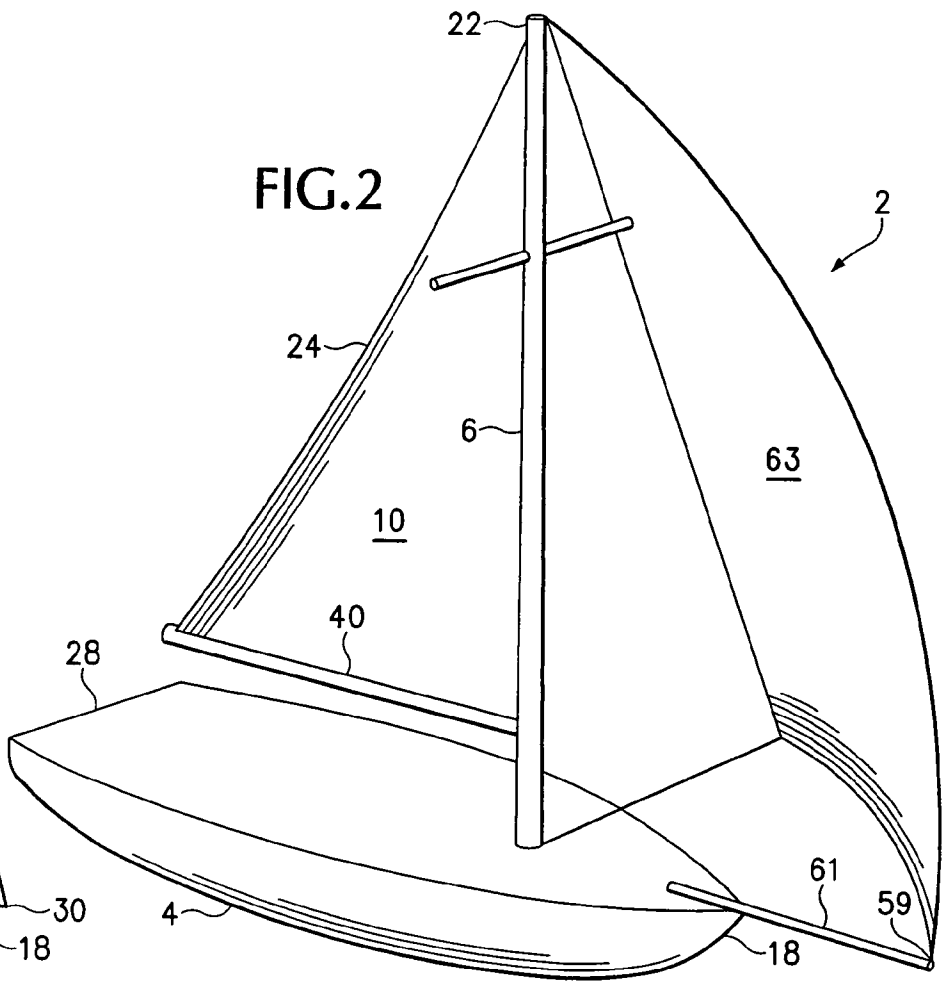
FIG. 2 illustrates a perspective view of a conventional sailboat having a second sail plan.
Figure 1:
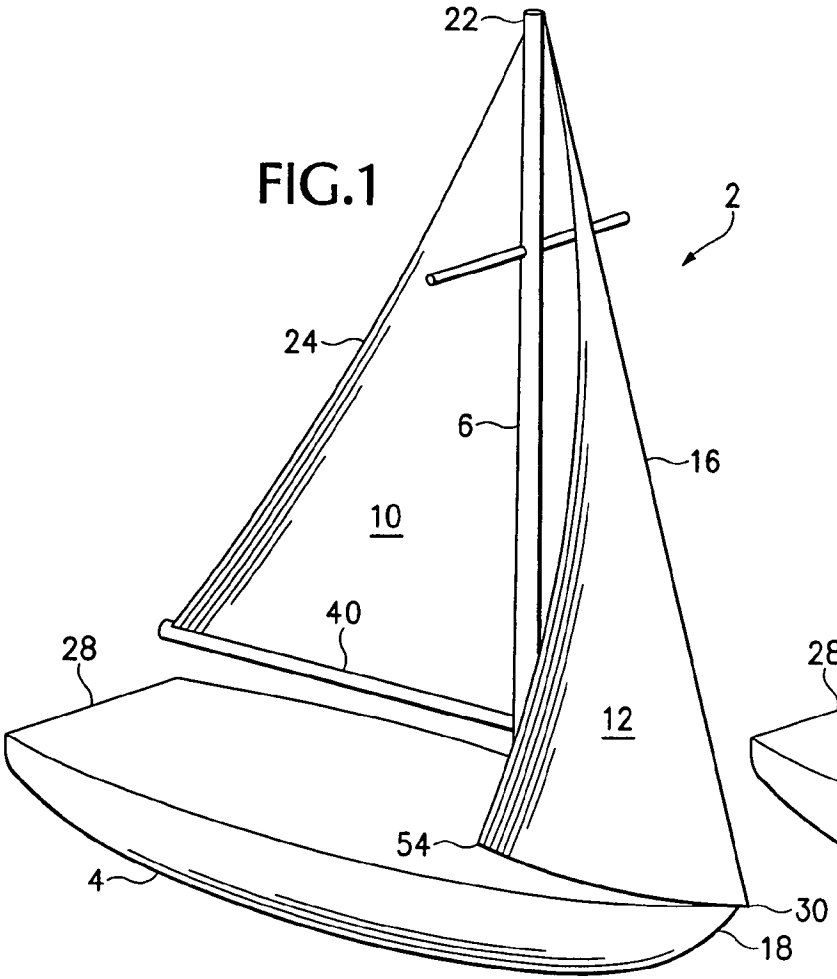
FIG. 1 illustrates a perspective view of a conventional sailboat having a first sail plan.

A retractable bowsprit is described with reference to the conventional Bermuda sloop shown in FIG. 1. However, the bowsprit described herein can be easily adapted to any type of sailing vessel and any use of a conventional bowsprit.

Figure 3:
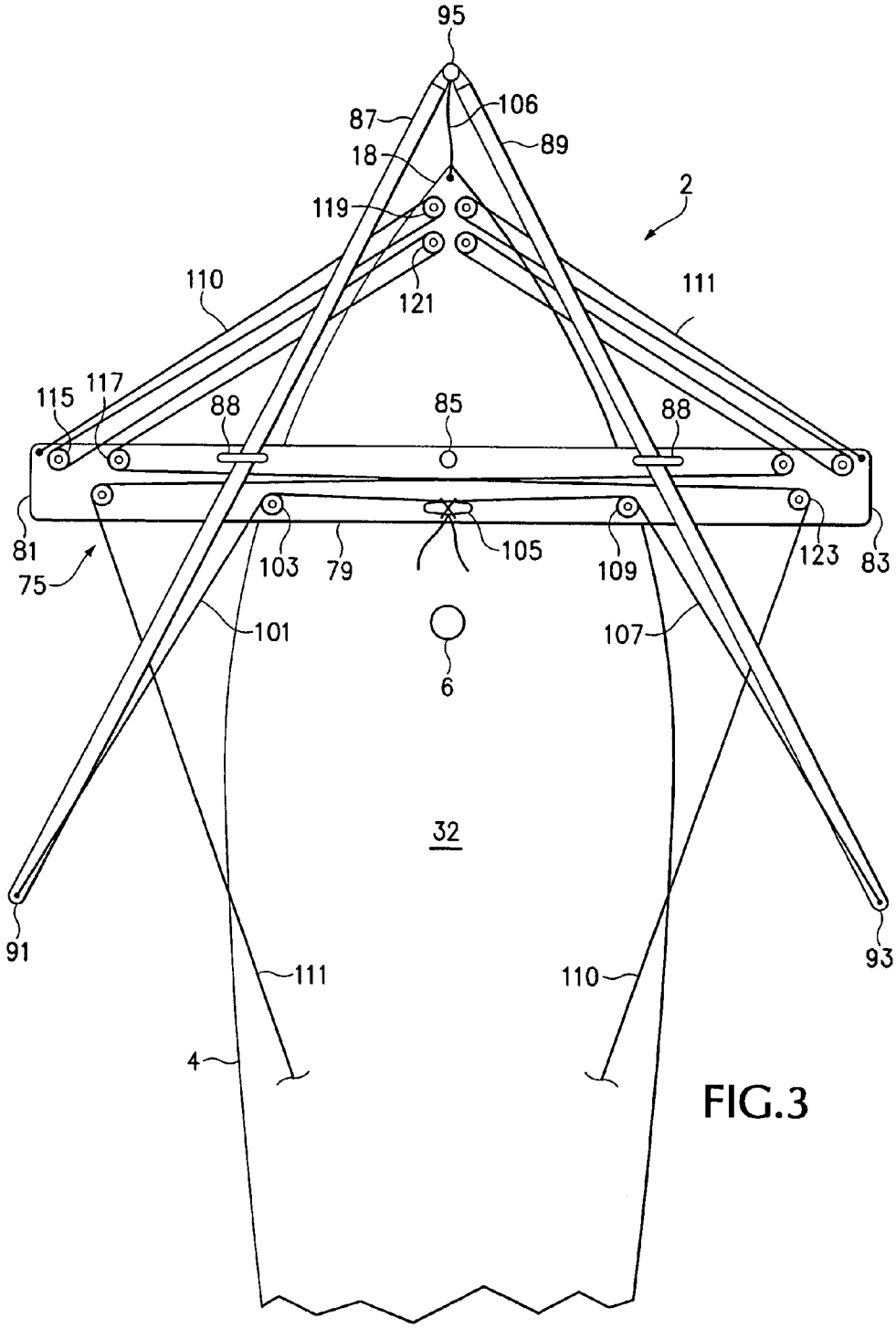
FIG. 3 illustrates a top view of a sailboat having an extendable and retractable bowsprit apparatus installed thereon, the bowsprit apparatus being in a retracted position.
Figure 4:
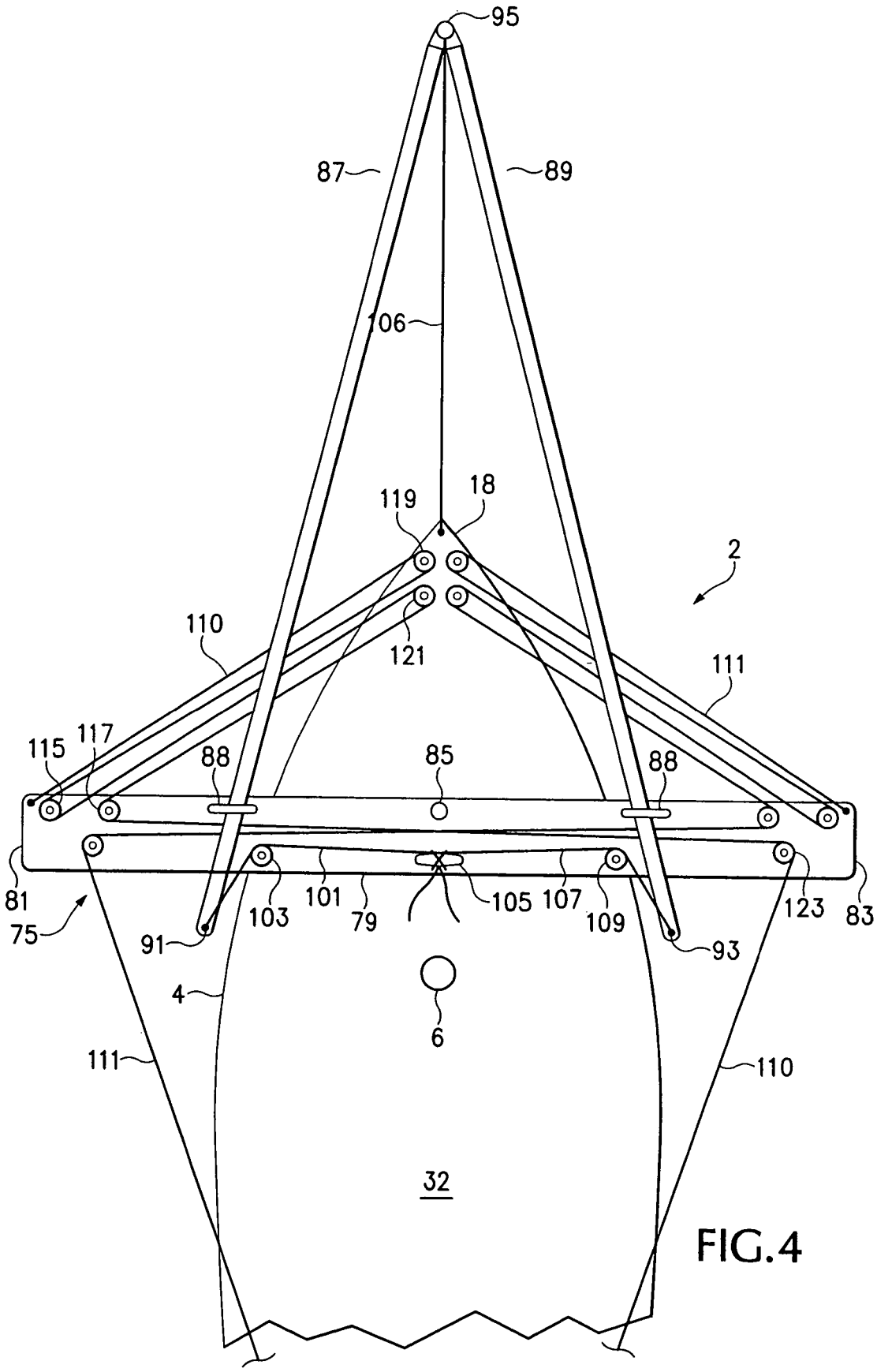
FIG. 4 illustrates the sailboat and bowsprit apparatus of FIG. 3, but with the bowsprit apparatus shown in an extended position.

Referring to FIG. 3, a retractable bowsprit assembly 75 is mounted on a conventional sailboat 2 and is shown in a retracted position. Bowsprit assembly 75 includes a support member 79 attached to the deck 32 forward of the mast 6. Support member 79 has port and starboard outer ends 81, 83 and is secured to the deck 32 via a centrally positioned pivot mount 85 allowing the support member to rotate about an axis perpendicular to the deck. A moveable spar 87 lies substantially along the port side of the outer hull 4, supported by the port end 81 of support member 79 and a similar moveable spar 89 lies substantially along the starboard side of the outer hull, supported by the starboard end 83 of the support member. In the retracted position, bowsprit 75 is positioned as far aft as possible relative to the sailboat 2, any further rearward movement being restricted by interference with the bow 18. Bowsprit 75 is moveable between the retracted position (as shown in FIG. 3) and an extended position (as shown in FIG. 4).

Support member 79 is centered over the keel line and is of sufficient length to allow both outer ends 81, 83 to extend past the port and starboard sides of the hull 4 respectively. The dimensions of a particular support member will depend on the size of the boat to which it is mounted. The underside of support member 79 has a connector (not shown) for connecting to pivot mount 85. The connection between the pivot mount 85 and the connector (not shown) is of any type allowing the support member to be securely and rotatably attached to pivot mount 85. The support member may include channels, guides, clamps, bars, or other means (indicated generally by 88) to limit the range of motion of the moveable spars.

Moveable spars 87, 89 each have respective forward ends and aft ends 91, 93. The forward ends are joined to one another to form a single forward end 95 of bowsprit 75. The spars may have any cross-sectional shape. The spars 87, 89 may be substantially straight, as shown in FIGS. 3 and 4, or may be at least partially curved, for instance to conform to the shape of the hull 4.

Support member 79 can be made of any material of sufficient strength and durability to withstand the intended use while preferably also being relatively lightweight and buoyant. The moveable spars can be made of any suitable rigid material.

The retractable bowsprit includes a means for causing the movable spars to move relative to the vessel between a first position where the apex formed by the forward ends 95 of the spars is proximate the bow of the vessel to a second position where the apex is further from the bow. A port extension line 101 is affixed to the port spar's aft end 91 and runs through pulley 103 on port outer end 81 to a bracket 105 in the center of the support member 79. A starboard extension line 107 is affixed to the starboard spar's aft end 93 and runs through pulley 109 on starboard outer end 83 to the bracket 105. To move bowsprit 75 from the retracted position to an extended position, an operator (not shown) in the vicinity of support member 79 pulls evenly on both extension lines from the bracket 105 towards the stern, causing the line to pull spars 83, 87 forward. A retraction line 106 is secured between the bow 18 and the bowsprit's forward end 95. The retraction line 106 prevents the bowsprit 95 from being extended too far forward and allows for the bowsprit's retraction from the extended position. Prior to extension, the tack of a downwind sail can be affixed to the forward end 95. Extension of the bowsprit 95 thus allows for use of a larger sail to be used than would otherwise be possible.

Referring to FIG. 4, when in the extended position, the orientation of bowsprit 75 relative to the bow 18 is controlled by port and starboard orientation lines 110, 111 and corresponding port and starboard orientation pulley systems. By cooperatively manipulating the orientation lines 110, 111, an operator (not shown) causes support member 79 to pivot through a range of rotation. In an embodiment of the extendable bowsprit 75, the port orientation pulley system includes port support member pulleys 115, 117 attached to the support member's port outer end 81, bow pulleys 119, 121 attached on the port side of the bow 18, and a starboard support member pulley 123 attached at the starboard outer end 83. Port orientation line 110 is affixed to the support member's port outer end 81 and runs from the port outer end through the bow pulley 119, port support member pulley 115, bow pulley 121, port support member pulley 117, across support member 79 to starboard support member pulley 123 and then aft. Where port orientation line 110 is available for manipulation. The port pulley system is mirrored by a starboard pulley system, the starboard orientation line 111 running from the support member's starboard outer end 83, through the starboard pulley system to sail boats aft.

When the downwind sail is no longer required, an operator (not shown) may move bowsprit 75 from the extended position to the retracted position by pulling on the retraction line 106. The downwind sail can then be safely retrieved.

An embodiment of the bowsprit described herein can be provided in kit form for installation on a conventional sailboat. A non-limiting example of the contents of such a kit includes a support member, first and second spars, and a pivot assembly for mounting the support member to the deck of the conventional sailboat. The kit versions of the support member and spars may be provided in such dimensions that a single kit is installable on a wide variety of sailboats, intentionally oversized such that an installer may trim off any excess to fit the kit's components to a specific sailboat, or custom sized and shaped to fit a specific sailboat design. Ancillary hardware such as lines, pulleys, etc. may either be provided with the kit or separately supplied, for instance by the purchaser or installer.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A bowsprit for a sailing vessel having a deck and a hull including a bow, a first side and a second side, said bowsprit comprising:

a supporting member having first and second opposing ends and pivotably attachable to said deck such that said opposing ends of said supporting member extend outwardly past said hull; and first and second movable members joined at an apex;

and wherein the first movable member is disposed substantially adjacent to the first side of said hull and the second movable member is disposed substantially adjacent to the second side of said hull and said apex is forward of the vessel and the first and second movable members are slidably supported by said supporting member.

2. The bowsprit of claim 1, wherein pivoting said supporting member about said pivotal attachment to said deck changes an orientation of the bowsprit relative to said first side of said hull of said vessel.

3. The bowsprit of claim 1, further comprising a means for causing first and second movable members to move relative to said vessel between a first position with said apex proximate said bow and a second position with said apex further from said bow than said first position of said apex.

4. The bowsprit of claim 1 wherein said first end of said supporting member extends outwardly from said first side of said hull and said second end of said supporting member extends outwardly from said second side of said hull.

5. The bowsprit of claim 4 wherein said supporting member is pivotally attached to said deck at a location substantially midway between said first side of said hull and said second side of said hull.

6. The bowsprit of claim 1 wherein said supporting member is pivotally attachable to said deck at a location approximately midway between the first end and the opposing second end of said support.

* * * * *